United States Patent [19]

Barrett

[11] 4,193,846

[45] Mar. 18, 1980

[54] MANUFACTURING PROCESS OF A THIN METAL SHEET BY ELECTROLYTIC DEPOSIT

[75] Inventor: Fred Barrett, Wirral, England

[73] Assignee: Establissment Halgar, Geneva, Switzerland

[21] Appl. No.: 930,734

[22] Filed: Aug. 3, 1978

[30] Foreign Application Priority Data

Aug. 3, 1977 [CH] Switzerland ..... 9552/77

[51] Int. Cl.[2] ..... C25D 1/04; C25D 1/20

[52] U.S. Cl. ..... 204/13; 204/274

[58] Field of Search ..... 204/13, 274, 277

[56] References Cited

U.S. PATENT DOCUMENTS

| | | | |
|---|---|---|---|
| 2,439,491 | 4/1948 | Schiffl | 204/277 |
| 3,817,843 | 6/1974 | Barrett | 204/13 |
| 4,076,597 | 2/1978 | Subramanyan et al. | 204/13 |
| 4,077,863 | 3/1978 | Nasser | 204/274 |
| 4,129,492 | 12/1978 | Morton et al. | 204/13 |

FOREIGN PATENT DOCUMENTS

| | | | |
|---|---|---|---|
| 442236 | 9/1974 | U.S.S.R. | 204/13 |

*Primary Examiner*—T. M. Tufariello

*Attorney, Agent, or Firm*—Mandeville and Schewitzer

[57] ABSTRACT

Manufacturing process of a thin metal sheet, comprising depositing the metal by electrolysis from a bath containing an aqueous solution of a salt of this metal onto a mobile cathode formed by a rotating drum partially immersed in this bath, removing the metal sheet thus deposited from the non-immersed part of the drum, and replacing in the bath the metal deposited by electrolytic dissolution of an anode containing the same metal. The temperature of the bath is kept higher than its normal boiling point by maintaining on top of the bath a pressure at least equal to the boiling pressure.

8 Claims, 3 Drawing Figures

MANUFACTURING PROCESS OF A THIN METAL SHEET BY ELECTROLYTIC DEPOSIT

The object of the present invention is a process for manufacturing a thin metal sheet by electrolytic deposit.

We know how to produce a thin metal sheet on a mobile cathode by electrolysis of an electrolyte, and remove the metal sheet from the cathode.

During the process, the temperature of the electrolyte rises because of the dispersion of energy in the electrolyte due to the current flowing through it. The effect of this rise of temperature can be adjusted, either by further heating, or by cooling in order to provide the best conditions for obtaining the desired qualities of the metal sheet produced. It is particularly recommended to operate at a high temperature so as to obtain a good ductility of the deposited sheet.

Difficulties may then occur, due to the formation of gas bubbles at the surface of the deposit which can cause discontinuities or pits on the layer deposited, either by masking the surface, or by acting as a fixing nucleus for solid particles in suspension in the electrolyte. This defect is particularly noted when the depositing of a metal takes place at the boiling temperature of the electrolyte used, or at a temperature close to it.

The previous processes also comprise either the use of consumable anodes specially made to suit the application, or the dissolution of the raw material in the form of metal lumps or scrap-metal in the electrolyte in an outside tank.

The process according to the invention provides a remedy for these difficulties.

This process consists of depositing the metal by electrolysis from a bath containing an aqueous solution of a salt of this metal on a mobile cathode formed by a rotating drum partially immersed in this bath, of removing the metal sheet thus deposited from the non-immersed part of the drum, and of replacing in the bath the metal deposited by electrolytic dissolution of an anode containing the same metal. This process is characterized in that the temperature of the bath is kept higher than its boiling point by maintaining on top of the bath a pressure at least equal to the boiling pressure.

The process according to the invention has the following advantages with respect to the known processes:

The use of a device to keep the pressure in the area of the electrolysis higher than the atmospheric pressure allows the apparent boiling point of the electrolyte to rise and, therefore, the temperature of the electrolysis to rise above the normal boiling temperature of the electrolyte. This causes the suppression of the disadvantages of surface defects of the metal sheet produced due to the formation of big bubbles in the electrolyte by decreasing the size of these bubbles. This also decreases the applied voltage and consequently the operating cost while maintaining the qualities of the deposit and, furthermore, increases the permitted current density of the deposit thereby increasing the depositing speed while maintaining unchanged the qualities and in particular the ductility of the thin sheet produced.

The use of a consumable and refillable anode has the advantage that many metals which do not dissolve easily in an electrolyte are easily dissolved electrochemically so that the dissolution speed is practically balanced by the depositing speed, as well as the advantage of minimizing parasite reactions at the anode. In particular, in the case of iron deposit, the advantage of dissolving the anode by electrolytic reaction, is that it allows making up the level of the electrolyte while the deposit takes place without the formation of an excess of insoluble particles in the bath. As a matter of fact, certain precipitates make scrap which can correspond to a loss up to 30% of the material provided, and to a decrease of the general efficiency of the process.

The apparatus allowing the implementation of the process comprises the electrolysis cell and a circulation system for the bath.

The cell comprises means for adjusting the current density at the cathode, means to keep the pressure at the surface of the electrolyte at a predetermined value, means to heat the drum, means to separate the electrolyte into a cathodic compartment and into an anodic compartment while allowing the passage of the solution of the electrolyte towards the cathode and means to remove the metal sheet from the cell in the course of its production.

The anode is generally constituted of a consumable material introduced either in a continuous way or a discontinuous way.

According to the electrolyte and to the material deposited, the cathode can be made of titanium or of stainless steel with low sulphide content. This choice of the material allows the use of electrolytes having a different pH for different metals.

Most often, titanium is chosen when a low pH is used, in particular in the case of iron deposit where a low pH is used in order to obtain a product having a satisfactory ductility, without a further heat treatment being necessary.

The surface of the cathode can show annular thicknesses on its periphery, in order to delimit the width of the metal sheet deposited. Thus, the deposit of the metal sheet can be limited so that the edges of the material deposited do not need to be trimmed.

The circulation system of the bath comprises means to make the bath circulate, a tank separate from the cell through which the bath circulates and is cleared of all nondissolved material by filtration and/or sedimentation and means for cooling and heating the bath. According to the process of the invention, the temperature of the electrolyte being adjusted, the electrolyte circulates at uniform speed onto the cathode which is displaced simultaneously by uniform rotation of the drum. At the outlet of the cell, the bath is brought to a separate tank into which it circulates and it is cleared of all nondissolved material by filtration and/or sedimentation. For this purpose, the pressure of the electrolyte bath in circulation is brought down progressively to the atmospheric pressure by releasing vapour and the temperature is brought back by cooling to 102.5° C., which is the normal boiling temperature of the electrolyte.

The metal sheets which can be produced according to the present process are made of appropriate metals for electrolytic deposit, such as copper, nickel, zinc, tin, iron, etc. The thickness of the metal sheet obtained is most often comprised between 10 and 250 microns; for bigger thicknesses, traditional techniques such as lamination etc., are more economical generally than electrolytic deposit.

The accompanying drawings represent, as an example, a form of execution of an apparatus for the production of a metal sheet according to the invention.

Figure 1:
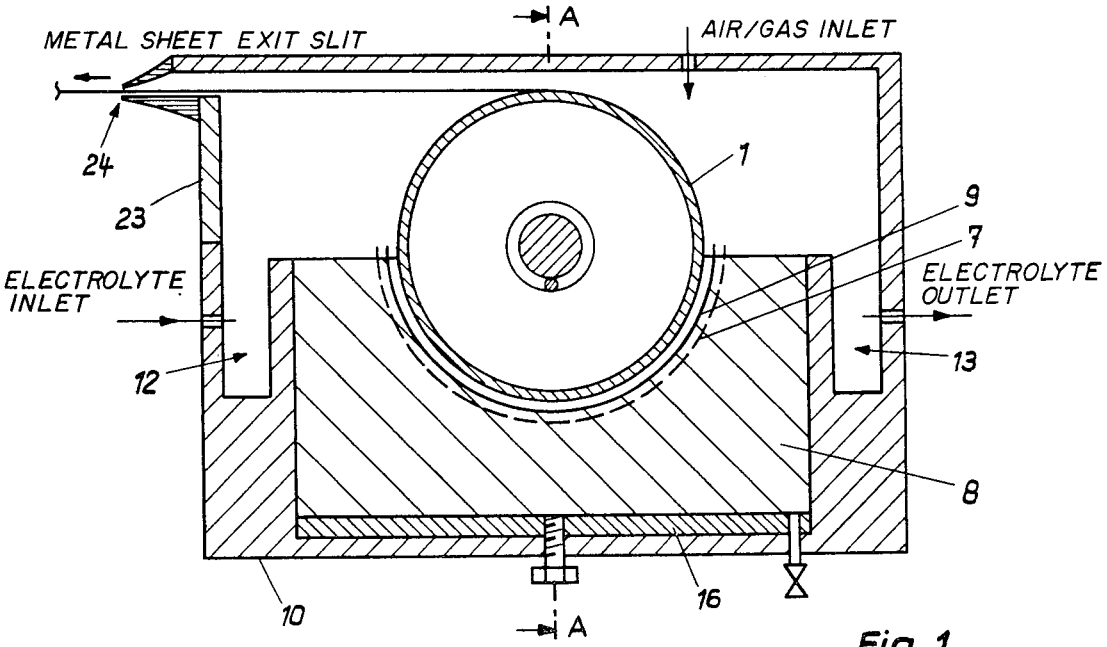
FIG. 1 is a cross sectional view of electroplating apparatus illustrating the invention.
Figure 2:
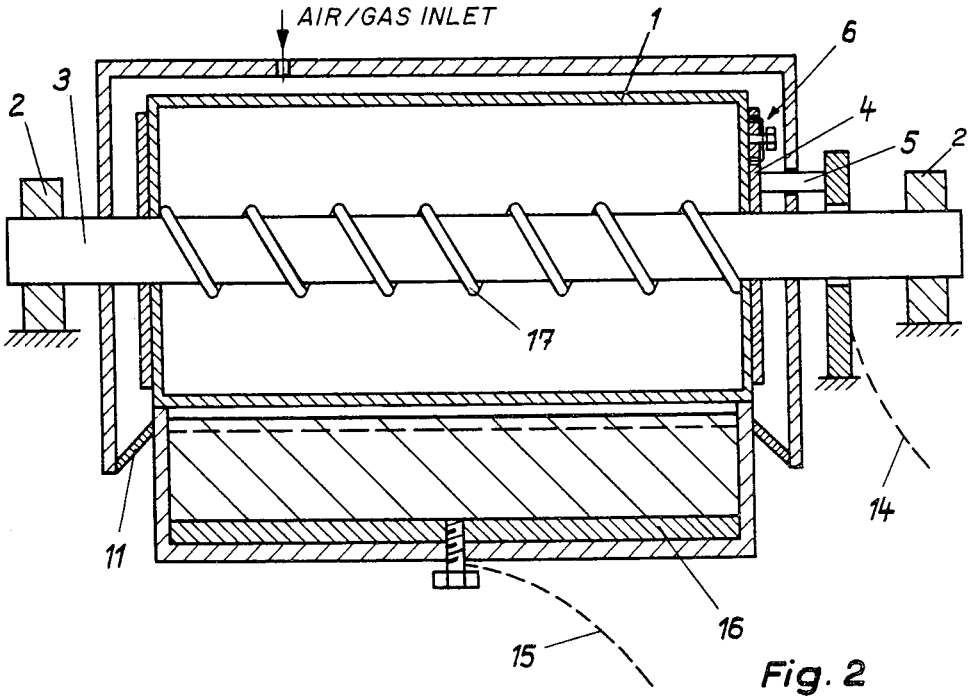
FIG. 2 is a sectional view taken along lines A—A.

In these drawings, a cylindrical cathode 1 made of titanium is mounted between assemblies of bearings 2 on a tubular shaft 3 of substantial diameter. At each end of the cylinder, a current collector plate 4 and sliding brushes 5 are mounted in such a position that the current is brought by the brushes towards the collector plate. In addition to mechanical connections, electric connections 6 from the plate to the end of the cylinder ensure a good conductivity and minimize the loss resistance. Under the cathode a porous or woven membrane 7 is placed between the refillable surface of the anode 8 and the surface of the cathode, keeping the gap as small as possible, while maintaining a spacing. A permeable screen 9 can also be placed between the cathode and the membrane. The membrane 7 and the screen 9 have the function of preventing solid particles contained in the bath from going towards the cathode.

An outside box or container 10 surrounds the area of the anode and contains half of the cathode approximately. The sides are shaped concentrically to the cathode and a section in form of a channel 11 made of a resistant material, for example polytetrafluorethylene, is fixed to the box in order to make it partially tight. This joint prevents the deposit of metal in this area, thus maintaining an acceptable quality of the edges of the material produced.

Figure 3:
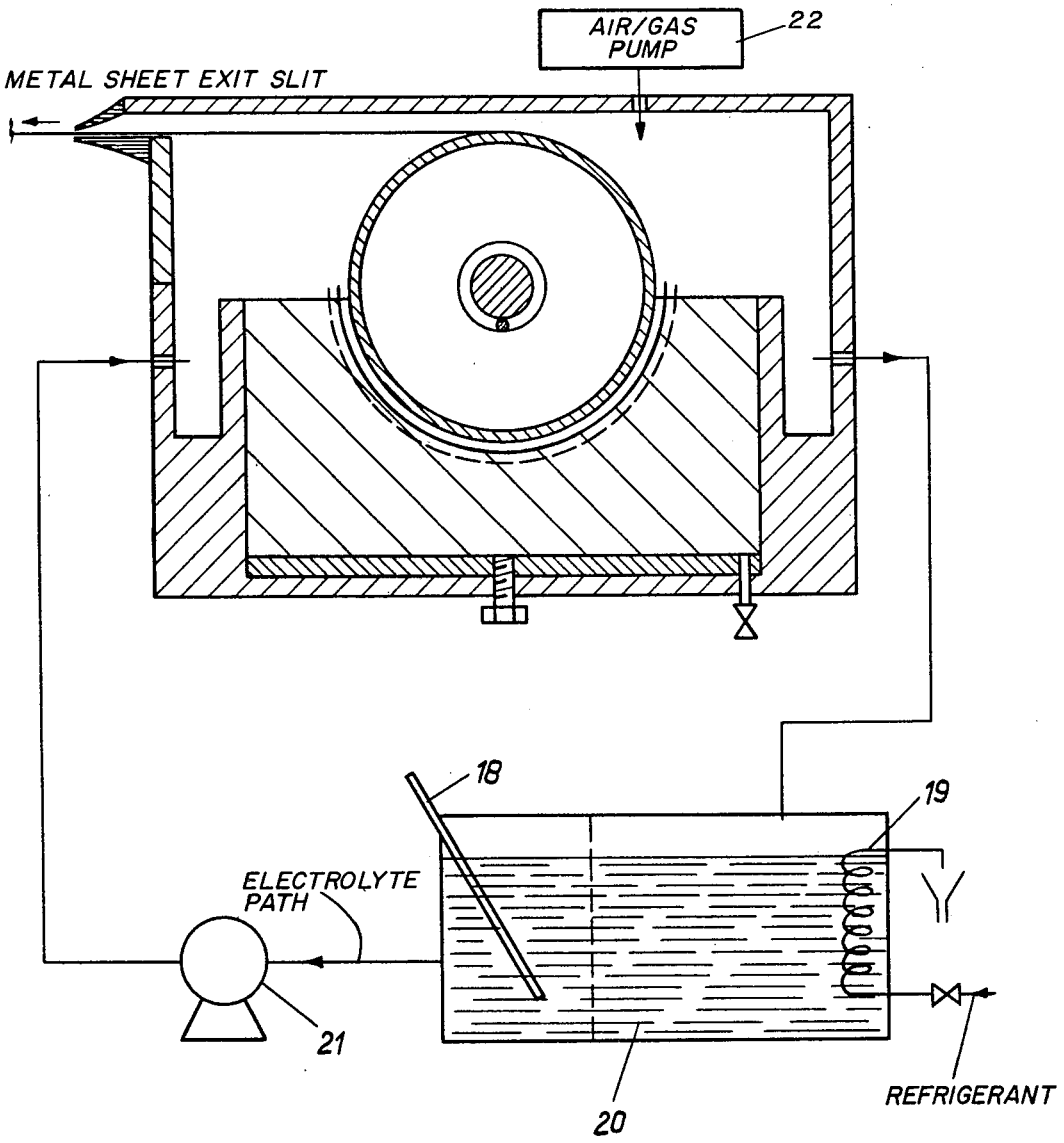
FIG. 3 is a schematic showing how the circulation of the bath works.

The electrolyte is introduced in the cell by a collector-overflow 12 so that the current is divided, one part going in the region between the cathode and the membrane, and the rest going in the space of the anode. Thus the currents of the anolyte and of the catholyte are separate during the process of electrolytic deposit and they merge back together in an outlet collector 13, where the residual electrolyte is discharged for the filtration and the recycling as indicated in FIG. 3.

The cathode is connected to the current source by a wire 14 and the anode by a wire 15 which is connected to a distribution plate 16 in the anode box. This plate can be made of titanium or graphite depending on the electrolyte used.

Heating elements 17 are mounted in the cathode to raise its temperature, and heating control elements comprising a thermostat 18 and a cooling coil 19 are mounted in a supply tank 20 in the electrolyte circuit to allow the adjustment of the electrolyte temperature. The electrolyte is put into circulation by means of a pump 21.

The area of the deposit is kept at a pressure adjusted by using an air pressure provided by the air pump 22, a lid 23 being mounted to enclose the open zone of the box, and means 24, a slit for example, in order to remove continuously the metal sheet deposited.

EXAMPLE

The electrolyte is composed of a ferrous chloride solution with a molarity of 3.0 to 3.1.

The pH is kept between 0.6 and 0.8.

The electrolyte temperature is 103° C.

The pressure is slightly higher than the atmospheric pressure.

The circulation speed of the bath is maintained between 10 and 25 cm/sec.

The current density at the cathode is 0.9 to 1 A/cm$^2$.

The temperature of the cathode is comprised between 102°-104° C.

The temperature of the anode is 70° C.

Under these conditions, a metal sheet is obtained of which has an the J.B value is comprised between 18 and 24 and which elongation of 12-13%.

To do the nickel electrolysis, an electrolyte having the following composition can be used:

| | |
|---|---|
| nickel sulphamate (tetrahydrate) | 300 g/l |
| nickel chloride (hexahydrate) | 6 g/l |
| boric acid | 35 g/l |

The copper electrolysis can be done from an electrolyte having the following composition:

| | |
|---|---|
| sulphuric acid | 200 mg/l |
| copper sulphate (hydrated) | 120 mg/l |
| cupric chloride | 25 mg/l |
| lignin sulphate | 2 mg/l |

The electrolyte can also contain aluminium chloride to increase its conductivity.

The surface of the rotative cathode can be masked partially by an appropriate treatment in order to obtain a thin metal sheet presenting a pattern. Hence, the invention allows the manufacture of element-plates for batteries, small components for electric and electronic equipment, razor blades etc. It suits perfectly the mass production of similar components which can be supplied in form of long strips attached one to the other, making the subsequent assembly easier while eliminating the waste of raw materials which affects the usual boring and machining operations.

The surface of the cathode can be masked by all the methods known, for example by a partial coating of synthetic material, or by chemical print.

What is claimed is:

1. Manufacturing process of a thin metal sheet, comprising depositing the metal by electrolysis from a bath containing an aqueous solution of a salt of this metal onto a mobile cathode formed by a rotating drum partially immersed in this bath, removing the metal sheet thus deposited from the non-immersed part of the drum, and replacing in the bath the metal deposited by electrolytic dissolution of an anode containing the same metal, the temperature of the bath being kept higher than its normal boiling point by maintaining on top of the bath a pressure at least equal to the boiling pressure.

2. Process according to claim 1, wherein the bath circulates constantly through a separate tank to remove by filtration and/or sedimentation all non-dissolved material in the bath.

3. Process according to claim 1 or claim 2, wherein the bath is injected into the said tank by decreasing the bath pressure down to the atmospheric pressure, and the water vapour thus released is collected to heat the bath during the electrolysis.

4. Process according to claim 1, characterized in that the drum is heated.

5. Process according to claim 1, characterized in that a permeable membrane for the salt of the metal is placed between the anode and the drum serving as a cathode.

6. Process according to claim 1, characterized in that a permeable screen for the salt of the metal is placed between the anode and the drum serving as a cathode.

7. Process according to claim 2, characterized in that the bath circulating in the said tank is cooled.

8. Process according to claim 1, characterized in that the surface of the rotative cathode is partially masked in order to obtain a thin metal sheet presenting a pattern.

* * * * *